US005553745A

United States Patent [19]

McMillian

[11] Patent Number: 5,553,745

[45] Date of Patent: Sep. 10, 1996

[54] BEVERAGE CONTAINER AND DISPENSER

[76] Inventor: Ray M. McMillian, 12060 Springdale Lake Dr., Cincinnati, Ohio 45246

[21] Appl. No.: 379,775

[22] Filed: Jan. 27, 1995

[51] Int. Cl.[6] ..... B65D 35/08

[52] U.S. Cl. ..... 222/92; 222/212; 222/515

[58] Field of Search ..... 222/92, 107, 210, 222/212, 215, 511, 515; 137/614.21, 903

[56] References Cited

U.S. PATENT DOCUMENTS

| | | | |
|---|---|---|---|
| 2,738,107 | 3/1956 | Graham . | |
| 3,390,821 | 7/1968 | Mullan | 222/212 |
| 4,368,832 | 1/1983 | Lambert | 222/509 |
| 4,645,100 | 2/1987 | Wells | 222/505 |
| 4,801,053 | 1/1989 | Kaster | 222/506 |
| 5,244,011 | 9/1993 | Feldinger | 137/614.13 |

*Primary Examiner*—Andres Kashnikow

*Assistant Examiner*—Kenneth Bomberg

*Attorney, Agent, or Firm*—Richard C. Litman

[57] ABSTRACT

A container for holding and dispensing carbonated beverages characterized by a top portion, a bottom portion, and a side wall portion in the form of collapsible tubular bellows. A valve for dispensing a fluid is removably mounted on the container and communicates with the interior portion of the container. The valve includes a valve chamber having an opposing fluid inlet and fluid outlet and two oppositely disposed valve seats positioned adjacent to the inlet and the outlet respectively. Two oppositely disposed poppet valves, each having a stem centrally extending therefrom, are cooperatively movable between a closed position sealingly engaging the valve seats and an open position allowing fluid flow through the valve. The poppet valves are coupled to a shaft by the stems. The shaft is arranged to move linearly in a direction perpendicular to the longitudinal axis of the valve between a first position and a second position such that the shaft urges each of the poppet valves into the open position when the shaft is in the second position.

18 Claims, 2 Drawing Sheets

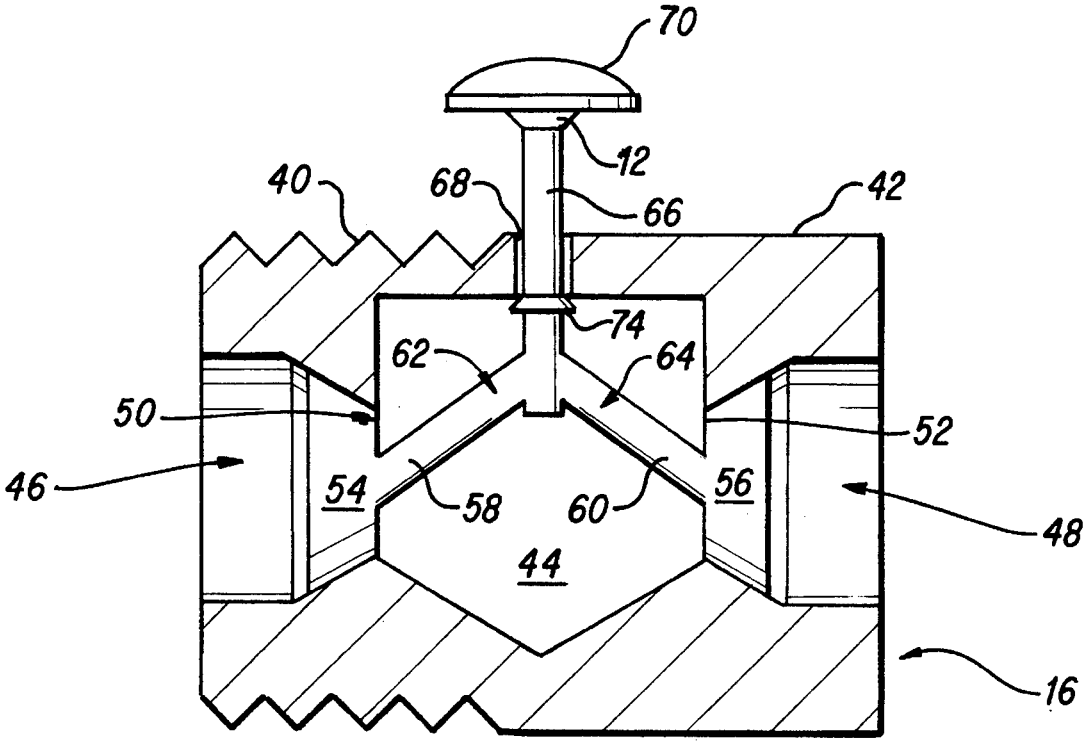
FIG. 2
FIG. 3
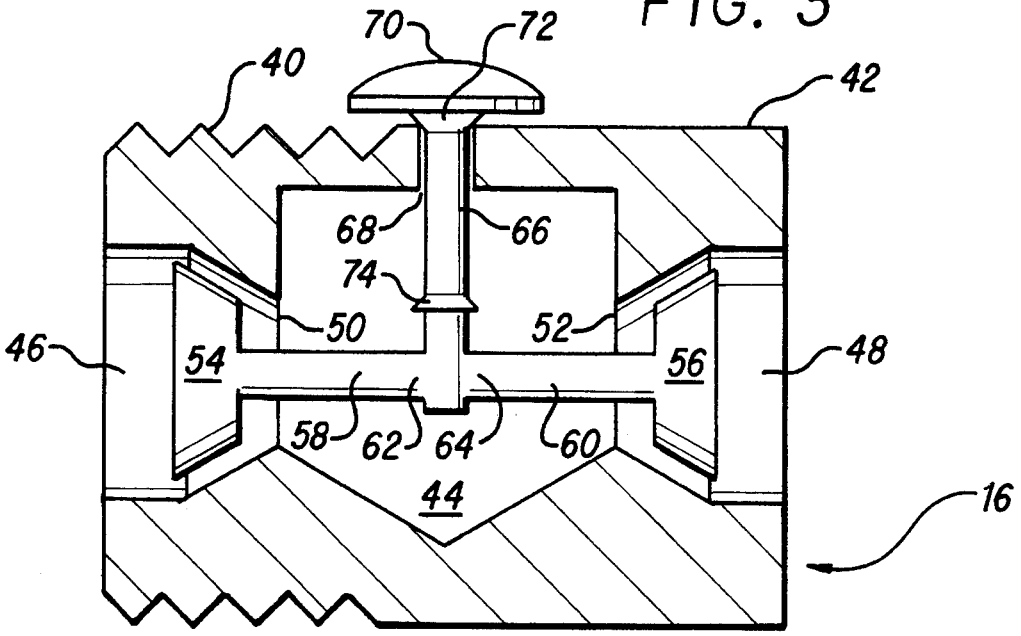

BEVERAGE CONTAINER AND DISPENSER

BACKGROUND OF THE INVENTION

1. Field of the Invention

The present invention relates to containers and fluid dispensing valves.

2. Description of the Prior Art

Soda and other carbonated beverages are sold in a variety of different sized containers, the most popular being the plastic two-liter bottle. The popularity of the two-liter bottle stems from its cost effectiveness—it offers the most volume of beverage for the least amount of money. Additionally, a two-liter bottle is easier to store and carry than the same volume of beverage packaged in 12-ounce cans or bottles. However, the two-liter bottle has one drawback—carbonated beverages tend to rapidly lose carbonation if not consumed soon after the bottle is first opened. Improper sealing of the bottle and increased air space in the bottle can cause the beverage to lose its carbonation. No container is seen in the prior art which effectively stores a carbonated beverage while maintaining its carbonation when the container is not filled to capacity.

U.S. Pat. No. 2,738,107, issued to Elizabeth N. Graham on Mar. 13, 1956, describes a container for dispensing liquids having collapsible accordion pleated walls. U.S. Pat. No. 3,390,821, issued to Joseph Mullan on Jul. 2, 1968, shows a container having vertically collapsible side walls and a valved outlet passage at the top. The above referenced patents do not teach or suggest a collapsible beverage container having a dispensing valve characterized by two oppositely disposed poppet valves for sealing the inlet and the outlet of the valve.

U.S. Pat. No. 4,368,832, issued to Louis J. Lambert on Jan. 18, 1983, shows a fluid dispensing valve having a deformable diaphragm to seal the valve seat when closed. U.S. Pat. No. 4,645,100, issued to Peter R. Wells on Feb. 24, 1987, describes a dispensing spigot for a container in which the spigot is mounted on a spout and a portion of the deformable diaphragm wall sealingly engages the internal surface of the spout wall. U.S. Pat. No. 4,801,053, issued to Eugene J. Kaster on Jan. 31, 1989, describes a valved dispensing spout for a fuel can having a poppet valve slidably mounted therein. The valve is connected to a horizontal plunger via a link and the plunger extends through the wall of the valve housing for operation of the valve. U.S. Pat. No. 5,244,011, issued to Edgar Feldinger on Sep. 14, 1993, shows a fluid control valve having two eccentrically and rotatably mounted, oppositely disposed plug elements arranged for sealing the inlet and outlet of the valve. The above referenced patents do not teach or suggest a valve used in combination with a collapsible container for carbonated beverages.

None of the above inventions and patents, taken either singly or in combination, is seen to describe the instant invention as claimed.

SUMMARY OF THE INVENTION

The present invention is directed to a container for holding and dispensing carbonated beverages. The container is characterized by a top portion, a bottom portion, and a side wall portion in the form of collapsible tubular bellows. A valve for dispensing a fluid is removably mounted on the container and communicates with the interior portion of the container. The valve includes a valve chamber having an opposing fluid inlet and fluid outlet and two oppositely disposed valve seats positioned adjacent to the inlet and the outlet respectively. Two oppositely disposed poppet valves, each having a stem centrally extending therefrom, are cooperatively movable between a closed position sealingly engaging the valve seats and an open position allowing fluid flow through the valve. The poppet valves are coupled to a shaft by the stems. The shaft is arranged to move linearly in a direction perpendicular to the longitudinal axis of the valve between a first position and a second position such that the shaft urges each of the poppet valves into the open position when the shaft is in the second position.

Accordingly, it is a principal object of the invention to provide a collapsible beverage container for storing and dispensing carbonated beverages.

It is another object of the invention to provide a collapsible beverage container that reduces the amount of carbon dioxide escaping from the carbonated beverage by reducing the volume of air above the beverage.

It is a further object of the invention to provide a collapsible beverage container for storing carbonated beverages including a valve for dispensing fluids.

Still another object of the invention is to provide a collapsible beverage container for storing carbonated beverages including a valve designed to reduce the amount of air allowed into the container by simultaneously closing the inlet and the outlet of the valve.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a side elevational view in cross section of the valve showing the valve in the closed position.

FIG. 3 is a side elevational view in cross section of the valve showing the valve in the open position.

Similar reference characters denote corresponding features consistently throughout the attached drawings.

DETAILED DESCRIPTION OF THE PREFERRED EMBODIMENT

Figure 1:
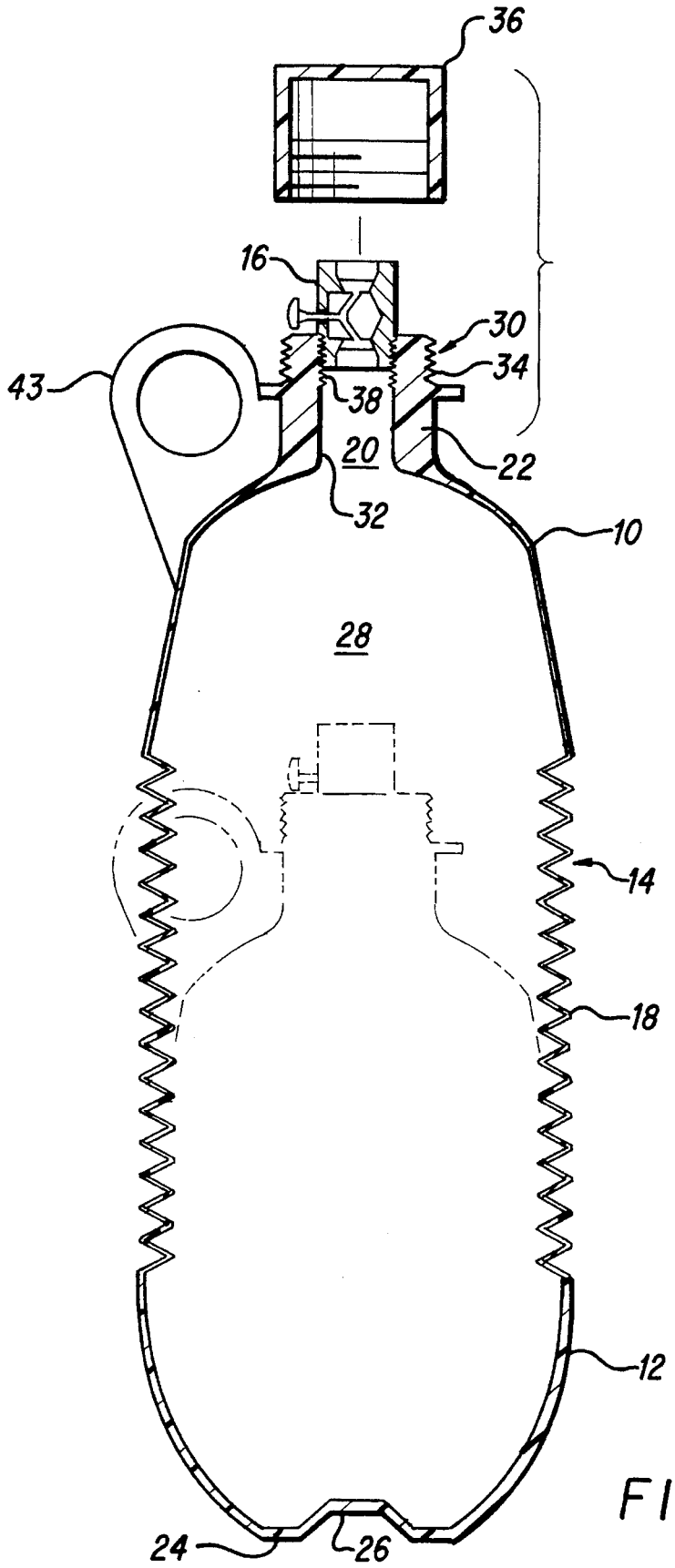
FIG. 1 is a side elevational view of the invention showing the container in both the expanded and collapsed positions.

A container for holding carbonated beverages is shown in FIG. 1. The major components of the container include a top portion 10, a bottom portion 12, a side wall portion 14, and a valve 16.

Referring to FIG. 1, side wall portion 14 is in the form of a collapsible tubular bellows having a series of corrugated or accordion pleats 18. Top portion 10 includes a discharge opening 20 defined by an upstanding neck 22. Top portion 10 is generally concave in shape, tapering from side wall portion 14 upwardly and inwardly to discharge opening 20. Bottom portion 12 is shaped in the form of a bowl having an annular base 24 with a centrally located depression 26 therein. Bottom portion 12 extends from base 24 upwardly and outwardly to side wall portion 14. Top portion 10, bottom portion 12, and side wall portion 14 define an interior portion 28.

Neck 22 includes an outer surface 30 and an inner surface 32. External threads 34 are formed on outer surface 30 to matingly receive a removable cap 36 such that cap 36 seals discharge opening 20. Alternatively, cap 36 may be secured to neck 22 in a tight friction fit or by any other well known securing means. Internal threads 38 are formed on inner surface 32 to matingly receive external threads 40 on the housing 42 of valve 16 such that a seal is provided between valve housing 42 and inner surface 32 to prevent fluid leakage therethrough. Alternatively, valve 16 may be secured within neck 22 in a tight friction fit or by any other well known securing means. Although valve 16 is presently shown positioned within neck 22, valve 16 may be mounted in alternative positions along the container as long as communication between valve 16 and the fluid in the container is permitted.

A handle 43, in the form of a closed loop, is mounted on the container to allow a strap for carrying the container to pass therethrough or to allow the user to more easily grasp and manage the container.

Referring to FIG. 2 and FIG. 3, valve 16 for dispensing fluid includes valve housing 42 which defines a chamber 44. An opposing fluid inlet 46 and fluid outlet 48 are positioned within chamber 44. The longitudinal axis of valve 16 extends centrally through fluid inlet 46 and fluid outlet 48. A first valve seat 50 is positioned adjacent to fluid inlet 46 and a second valve seat 52 is positioned adjacent to fluid outlet 48. Two oppositely disposed poppet valves, 54 and 56, are located within chamber 44. A first valve stem 58 extends from the center of first poppet valve 54 and a second valve stem 60 extends from the center of second poppet valve 56. Poppet valves 54 and 56 are cooperatively movable between a closed position sealingly engaging a respective one of valve seats 50 and 52 and an open position allowing fluid flow through fluid inlet 46 and fluid outlet 48.

First stem 58 includes a first end 62 and second stem 60 includes a second end 64. Ends 62 and 64 are resiliently coupled to a shaft 66 at substantially the same location on shaft 66. Stems 58 and 60 are sufficiently resilient to allow stems 58 and 60 to flex or bend with respect shaft 66. Shaft 66 is arranged to move linearly in a direction perpendicular to the longitudinal axis of valve 16. Shaft 66 is movable between a first position and a second position. In the first position, shaft 66 urges stems 58 and 60 out of alignment with the longitudinal axis of valve 16 thereby moving poppet valves 54 and 56 into the closed position. In the second position, shaft 66 urges stems 58 and 60 into alignment with the longitudinal axis of valve 16 thereby moving poppet valves 54 and 56 into the open position. FIG. 2 shows poppet valves 54 and 56 in the closed position and shaft 66 in the first position. FIG. 3 shows poppet valves 54 and 56 in the open position and shaft 66 in the second position.

Shaft 66 passes through a hole 68 within valve housing 42. A push button 70 is mounted on shaft 66 for allowing a user to move shaft 66 between the first and second position by finger pressure. A ring-shaped, frusto-conical first seal 72 is mounted on shaft 66 adjacent to push button 70. First seal 72 sealingly engages hole 68 when shaft 66 is in the second position. A ring-shaped, frusto-conical second seal 74 is mounted on shaft 66 within chamber 44. Second seal 74 sealingly engages hole 68 when shaft 66 is in the first position.

Many alternative methods for returning poppet valves 54 and 56 to valve seats 50 and 52, respectively, are possible. In a first method, shaft 66, poppet valves 54 and 56, and stems 58 and 60 are formed together in a single piece of molded plastic with the shaft 66 in the first position. After moving shaft 66 to the second position, the molded plastic returns to its original shape thus bringing back shaft 66 to the first position. In a second method, a spring for biasing shaft 66 to the first position may be provided around shaft 66, extending between push button 70 and valve housing 42. In a third method, the container may be collapsed, thus increasing the fluid pressure in the container. Gas current from gas escaping through valve 16 urges shaft 66 into the second position, sealing valve 16 when finger pressure on push button 70 is released. In a fourth method, push button 70 may be manually retracted to move shaft 66 into the first position. The methods described herein are shown merely as examples and are not the only methods that would result in an operative embodiment of the invention.

It will be seen that by removing cap 36 from the container and opening valve 16, the container may be vertically or longitudinally compressed to reduced its volume. In the extended position, as shown in FIG. 1, the container may be completely filled with a liquid such as a carbonated beverage. As the volume of liquid in the container is diminished, and if cap 36 is removed and valve 16 is open, atmospheric pressure forces side wall portion 14 to collapse thus reducing the volume above the carbonated beverage and thereby reducing the amount of carbon dioxide that will escape from the beverage. The container may also be manually collapsed by removing cap 36, opening valve 16, and forcing the container down to the desired level. Once the desired level of the container is reached, valve 16 may be closed and cap 36 may be replaced to retain the desired level.

Fluid is dispensed from the container by first removing cap 36. Next, push button 70 is depressed thereby moving shaft 66 into the second position. In the second position, shaft 66 urges stems 58 and 60 into alignment with the longitudinal axis of valve 16 thus moving poppet valves 54 and 56 into the open position. Valve 16 may be closed by releasing push button 70 and allowing shaft 66 to move to the first position. In the first position, shaft 66 urges stems 58 and 60 out of alignment with the longitudinal axis of valve 16 thus moving poppet valves 54 and 56 into engagement with valve seats 50 and 52. Poppet valves 54 and 56 simultaneously engage valve seats 50 and 52 to close valve 16, thus reducing the amount of air allowed into the container.

It is to be understood that the present invention is not limited to the sole embodiment described above, but encompasses any and all embodiments within the scope of the following claims.

I claim:

1. A container for holding carbonated beverages comprising:

a top portion having a discharge opening formed therein;

a bottom portion;

a side wall portion extending from said top portion to said bottom portion, said side wall portion being in the form of a collapsible tubular bellows, said top portion, said bottom portion, and said side wall portion defining an interior;

a valve for dispensing fluid communicating with said interior, said valve having a valve housing defining a chamber, said chamber having an opposing fluid inlet and fluid outlet, said valve having a longitudinal axis centrally extending through said inlet and said outlet;

said valve having two oppositely disposed valve seats, said valve seats positioned adjacent said inlet and said outlet respectively;

said valve having two oppositely disposed poppet valves, each of said poppet valves having a stem extending therefrom, each of said poppet valves cooperatively movable between a closed position sealingly engaging a respective one of said valve seats and an open position allowing fluid flow through said inlet and said outlet;

said poppet valves coupled to a shaft by said stems, said shaft arranged to move linearly in a direction perpendicular to said longitudinal axis of said valve, said shaft movable between a first position and a second position, said shaft urging each of said poppet valves into said open position when said shaft is in said second position.

2. The container according to claim 1, further including a handle, in the form of a closed loop, mounted thereon to allow a strap for carrying said container to pass therethrough.

3. The container according to claim 2, wherein said valve is removably mounted in said discharge opening.

4. The container according to claim 3, wherein each of said stems of said poppet valves has an end, each of said ends being resiliently coupled to said shaft, said shaft urging said stems out of alignment with said longitudinal axis of said valve when in said first position, said shaft urging said stems into alignment with said longitudinal axis of said valve when in said second position, said shaft being biased toward said first position.

5. The container according to claim 4, wherein said valve housing defines a hole, said shaft passing through said hole and sealingly engaging said hole, said shaft having a push button for allowing a user to move said shaft to said second position by finger pressure.

6. The container according to claim 5, further including a removable cap sealingly engaging said discharge opening.

7. The container according to claim 1, further including a handle mounted thereon to allow a user to more easily grasp said container.

8. The container according to claim 7, wherein said valve is removably mounted in said discharge opening.

9. The container according to claim 8, wherein each of said stems of said poppet valves has an end, each of said ends being resiliently coupled to said shaft, said shaft urging said stems out of alignment with said longitudinal axis of said valve when in said first position, said shaft urging said stems into alignment with said longitudinal axis of said valve when in said second position, said shaft being biased toward said first position.

10. The container according to claim 9, wherein said valve housing defines a hole, said shaft passing through said hole and sealingly engaging said hole, said shaft having a push button for allowing a user to move said shaft to said second position by finger pressure.

11. The container according to claim 10, further including a removable cap sealingly engaging said discharge opening.

12. The container according to claim 1, further including a removable cap sealingly engaging said discharge opening.

13. The container according to claim 12, wherein said valve is removably mounted in said discharge opening.

14. The container according to claim 13, wherein each of said stems of said poppet valves has an end, each of said ends being resiliently coupled to said shaft, said shaft urging said stems out of alignment with said longitudinal axis of said valve when in said first position, said shaft urging said stems into alignment with said longitudinal axis of said valve when in said second position, said shaft being biased toward said first position.

15. The container according to claim 14, wherein said valve housing defines a hole, said shaft passing through said hole and sealingly engaging said hole, said shaft having a push button for allowing a user to move said shaft to said second position by finger pressure.

16. The container according to claim 1, wherein said valve is removably mounted in said discharge opening.

17. The container according to claim 16, wherein each of said stems of said poppet valves has an end, each of said ends being resiliently coupled to said shaft, said shaft urging said stems out of alignment with said longitudinal axis of said valve when in said first position, said shaft urging said stems into alignment with said longitudinal axis of said valve when in said second position, said shaft being biased toward said first position.

18. The container according to claim 17, wherein said valve housing defines a hole, said shaft passing through said hole and sealingly engaging said hole, said shaft having a push button for allowing a user to move said shaft to said second position by finger pressure.

* * * * *